US005687589A

United States Patent [19]

Yao et al.

[11] Patent Number: 5,687,589

[45] Date of Patent: Nov. 18, 1997

[54] BATCH DYEING SYSTEM WITH AUTOMATIC CHEMICAL-DOSING AND PH CONTROL SYSTEM

[75] Inventors: Shin-Chuan Yao; Jongfu Wu; Feng Biau Lin; Li-Ren Wang; Wei-Chin Wu; Yu-Cheng Wang; Judson Lee, all of Tu Cheng, Taiwan

[73] Assignee: China Textile Institute, Taipei, Taiwan

[21] Appl. No.: 611,512

[22] Filed: Mar. 7, 1996

[51] Int. Cl.[6] ..... D06B 23/00

[52] U.S. Cl. ..... 68/12.07; 68/207

[58] Field of Search ..... 68/12.07, 175, 68/177, 178, 207

[56] References Cited

U.S. PATENT DOCUMENTS

| | | | |
|---|---|---|---|
| 3,751,946 | 8/1973 | Claiborne | 68/12.07 |
| 3,916,651 | 11/1975 | Carruthers | 68/177 X |
| 4,656,846 | 4/1987 | Damm | 68/177 X |
| 5,072,472 | 12/1991 | Enderlin | 68/207 X |
| 5,497,637 | 3/1996 | Fuller et al. | 68/207 X |

FOREIGN PATENT DOCUMENTS

| | | | |
|---|---|---|---|
| 864982 | 4/1961 | United Kingdom | 68/12.07 |

*Primary Examiner*—Philip R. Coe

*Attorney, Agent, or Firm*—Morton J. Rosenberg; David I. Klein

[57] ABSTRACT

This automatic admixtrue dosing and pH value control batch dyeing system is comprised of a pH value gauge, a thermometrer, a pump for adding chemicals, a drain valve, a chemical tank, a continuous action depth gauge, a mixing valve, and a chemical input valve. The controller is designed to proceed according to several chemical graphs located inside the controller. The user, depending on the requirment of chemical dosing and pH value control, sets the time for inputting chemical and a predetermined pH value. When this is done, the controller, according to the selected chemical graphs and target pH values, operates the chemical pump, the mixing valve, and the chemical dosing valve. The chemical module flow into action, and the dye liquor in the chemical tank flow into the dye machine. The depth gauge, the pH gauge and the thermometer measurs the volume of liquid in the chemical tank, and the pH value and temperature of the dye liquid in the dye machine. The information is individually fed back to the controller which can automatically monitor the dye liquor pH value and chemical condition. The final stage consists of the automatic control of the chemical volume and pH value.

9 Claims, 5 Drawing Sheets

BATCH DYEING SYSTEM WITH AUTOMATIC CHEMICAL-DOSING AND PH CONTROL SYSTEM

BACKGROUND OF THE INVENTION

1. Field of the Invention

The invention is related to a batch-dyeing system with an automatic chemical-adding and pH-controlling system, especially to a mechanism which controls the addition of chemicals to the dye machine and controls the pH value. The control program automatically controls and monitors the addition of chemical and pH value.

2. Description of the Prior Art

Clothing has been used to provide protection for the human body ever since humans first used leaves and animal hides to cover themselves. As scientific knowledge increased, fabrics used for clothing has changed from the original natural materials to synthetic materials. Automation allowed us to manufacture our own clothes, and the dyeing process became very important. Dyeing can change the fabric color forever. It affects the appearance, color and luster of the material and is integrated with the manufacturing process.

In general, during the manufacturing process three basic elements of dyeing are the dye itself, a material to be dyed, and a dye medium. Generally the medium is water, allowing the dye to add directly to the material. However, different methods require different dyes. For example, dye acidity while dyeing wool, silk and polyamides produces color molecules with the acid positively charged particles.

As a result, the material attains a very bright luster. PET materials can also be dyed under the conditions of high acidity. On the other hand, bases dyes like purple and indigo dyes need a base liquid as a medium because they will not dissolve in water. For example: vulcanized dye, because it is made of a sulfur compound, with not dissolve in water and a base dye must be used as the medium. Also, base dyes are often used to dye cotton. As can be seen, the control of the pH value (acid-base value) during the dyeing process is a crucial factor.

In the ordinary textile industry dyeing process, the pH value of the dye has a great influence on the finished product. For example: during the coloring process, the speed of the reaction between the dye and the fabric molecules increases at a rate in direct proportion to the pH value. Therefore in order to control the first stage of the reaction, the pH value should not be too high. The volume of chemical added also has to be controlled. Conventionally chemicals are added manually and experienced and skillful people are needed to operate the machines. Not only the time and human resources are wasted, but also this method is inefficient and inaccurate. This affects the quality of the finished product. The result can be an unevenly colored and relatively low quality product. This is the modern textile industry beggest problem.

SUMMARY OF THE INVENTION

As a result, the inventor made an effort to search for improvement to dyeing methods. After several attempts, he finally invented a liquid dyeing system with automatic chemical-adding and pH control functions. He added several chemical control graphs to the controller. After predetermined pH values have been input, the user selects the appropriate chemical control graph.

The controller has two separate control modes—the volume control mode and the pH control mode. The controller organizes the operation of the machine and sequentially sets the motion of the chemical pump, the mixing valve, and the chemical adding valve. The appropriate quantity of liquid dye flows from the chemical tank to the dye machine. The pH value gauge and thermometer which are set inside the dye machine, and the depth gauge inside the chemical tank respond separately to the pH value of the dye liquor in the machine and the volume of material. In order to be able to respond to the pH values and chemical conditions, the chemical control structure is built into a closed loop. Thus the pH value and the quantity of chemical liquid added to the machine are more accurately controlled by the control machine. The present invention is completely automatic and is accurately controlled the dosing process.

The ability to add dye and to increase pH value allow a higher quality of dyed fabric, and improves the textile industry ability to compete.

DESCRIPTION OF THE DRAWING

Preferring embodiments of the invention are described below with reference to the accompanying drawings.

DESCRIPTION OF THE PREFERRED EMBODIMENT

Figure 1:
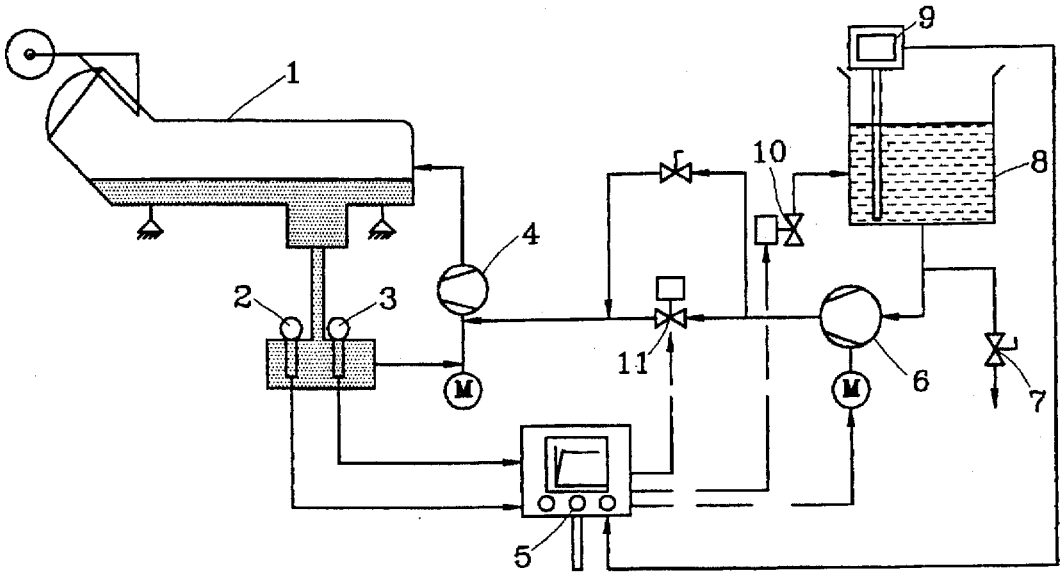
FIG. 1 shows the system of the present invention.

Now referring to FIG. 1, a dip-dye of the present invention for automatic chemical adding and pH control system includes dye machine 1 which is an immersion-style machine operated at normal temperature and normal pressure. The absolute pressure of the machine is less than 1 kg/cm2. The machine is operated up to 100 degree C., has no other special limitations and used to dye gauze and cloth; pH gauge 2 and thermometer 3 are located in the dye machine 1. The pH gauge 2 measuring the pH value of the dye liquor in dye machine 1 is made of glass electrodes and can withstand temperature of 135 degree C. A thermometer 3 measures the temperature of the dye liquor. A circulation pump 4 is a centrifugal-style pump which directs the flow in dye machine 1. A controller 5 is the central controller of the machine, which is modeled on an industrial computer and has the capability for network expansion, monitoring and control. By the function of the controller the dye is automatically added to the fabric during the manufacturing process. The controller can communicate with other control units. It can process materials and connect to and operate surrounding equipment. The controller 5 is very flexible, it contains two operation styles (manual and automatic). It can control the mixing, dissolving, cleaning and output functions of the chemical tank. The automatic operation of the controller has two modes—the dosing control mode and the pH value control mode. Only when operating, one of these two modes is set in each time. The entire operation depends on the input information from the operator. The operational characteristics of the controller are shown below.

CHART 1

| Item | Main Function | Second Function | Explanation | Characteristic |
|---|---|---|---|---|
| 1 | pH control mode | User's settings | Line or standard line characteristic curves (FIG. 4) | wide selection range |
| | | User's settings | Adds acid or alkale | Suits manykinds of dye process |
| | | Shortest chemical addition time | 0.2 sec | high sensitivity |
| | | Smallest chemical curve | 20 cc/time | High precision |

| Item | Main Function | Secondary Function | Explanation | Characteristic |
|---|---|---|---|---|
| | | Non-continuous | chemical time error monitors and auto-adjust | safe operation |
| | | Precision control | Error relatively low at +0.2% | High stability |
| | | Working temp. | 20° C.–100° C. | hardware automatically pH compensates |
| | | Alarm function | Temperature alarm | pH sensor safeguarad |
| | Volume control mode | provides more chemical curves | 6–8 useful curves | Simplified steps |
| | | Smallest chemical addition separations | Under 0.2% | High precision |
| | | User set up | Add chemical stages (add all at same time) | High resilience |
| | | Proper machine type and chemicals | No special limitations | Wide range of uses |
| | | Alarm function | Control auto-test | Protection system |

Figure 2:
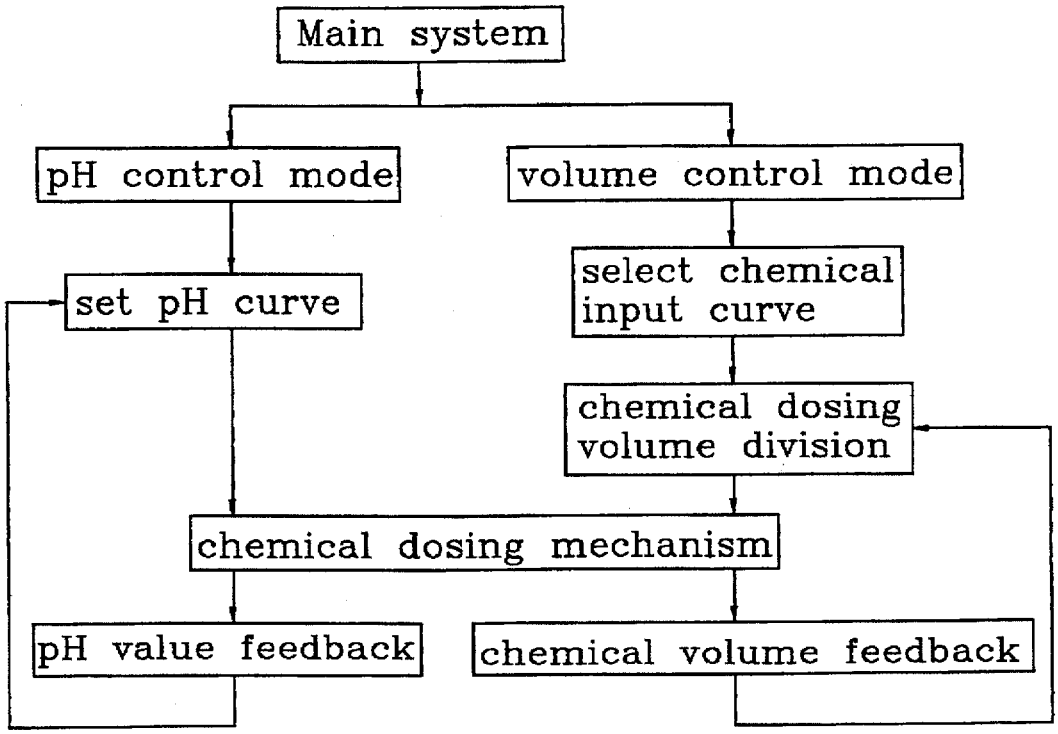
FIG. 2 shows the flow chart of the central control mechanism for chemical addition flow charts.

Both the pH value control mode and the dosing control mode can provide the pH value control and chemical dosing curves to the user. A chemical adding pump 6 is a centrifugal style pump with a power output of 1 horsepower and a pressure increase rate of 0.5–30 kg/cm2. It is the main power source of dye machine 1. A drain valve 7 is manually operated and consists of a ball valve and is set in the basis of chemical tank 8 the volume of which is 200 liters and is made of SUS 304 stainless steel. A continuous action depth gauge 9 for measure 0–80 cm depths with a precision of +or –0.2% is set in chemical tank 8 so to measure the level of the liquid. A mixing valve 10 is set in the output pipe between tank 8 and chemical pump 6. It mixes the liquid flowing from the chemical tank 8. A chemical dosing valve 11 consists of a cork valve and is set in the pipe between chemical pump 6 and dye machine 1. It is the main element in the chemical control driver and can put the dye liquid from chemical pump 6 into dye machine 1. A mixing valve 10 and chemical valve 11 described above both contain electromagnetically driving valves which are modeled with electromagnetic valves and are controlled by the controller 5. In the same way, the chemical pump 6 is controlled by the controller 5. The information about the dye pH value, the dye machine 1 temperature and the liquid depth of the chemical tank 8 is fedback from the pH gauge 2, thermometer 3 and depth gauge 9 to the controller 5, and thereby provides a reference for the automatic control of chemical and dye liquid pH levels. Those described above are the framework and control loop above the pH values of present invention. The first chart describes the framework for the dip dye automatic chemical-adding and pH control system. Now referring to FIG. 2, FIG. 2 shows the primary automatic control processes of the controller 5, including the pH value control mode and the volume control mode. It shows that the controller 5 provides the primary system for circulation control. The primary system of controller 5 (i.e. the primary control program), depending on the control mode (the pH value or volume), controls dye addition of the dye machine 1 and pH value.

The flow sequence of controlling occurs in the pH control mode. Firstly, the predetermined pH value is input by the user and then the system proceeds to monitor the pH value. In the volume control mode, the user inputs the chemical time, chooses the chemical curve, and carries out the chemical volume separation. Then, in a step-by-step fashion, the mechanism (consisting of the chemical pump 6, mixing valve 10, and adding chemical valve 11), allows the dye liquid flow from chemical tank 8 into dye machine 1. Then pH gauge 2 and thermometer 3 in the dye machine proceed to provide pH value. Then it returns under the pH control mode circulation procedure, and proceeds to circulate around the loop. The depth gauge 9 is used to set in chemical tank 8 for processing the chemical volume feedback procedure and then return to the volume control mode flow sequence. In the same way, it proceeds around the loop circulation flow sequence. So, the flow sequence of controlling for this invention constitutes the dip-dye automatic add chemical and pH control system.

Now referring to FIGS. 3–8. The controller 5 of the present invention is concerned mainly with the pH value control and dosing control modes in the dip dyeing process and forms the two basic aspects of this process for controlling the automatic addition of chemicals.

Figure 3:
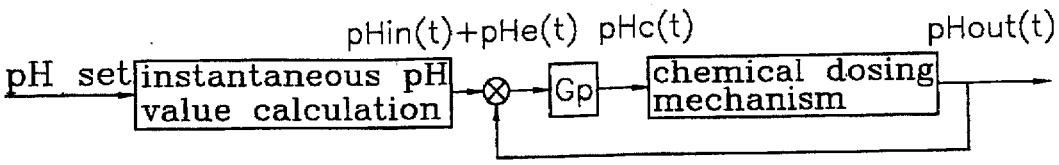
FIG. 3 shows the flow chart for the function of the pH control mode.
Figure 4:
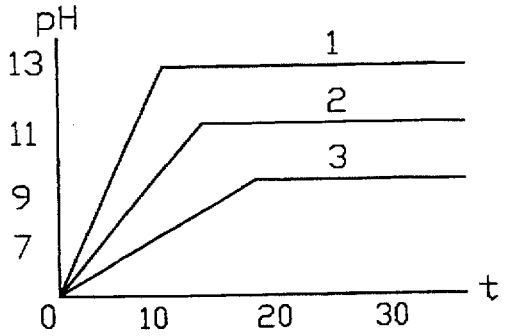
FIG. 4 shows the curve of the pH value planning.
Figure 7:
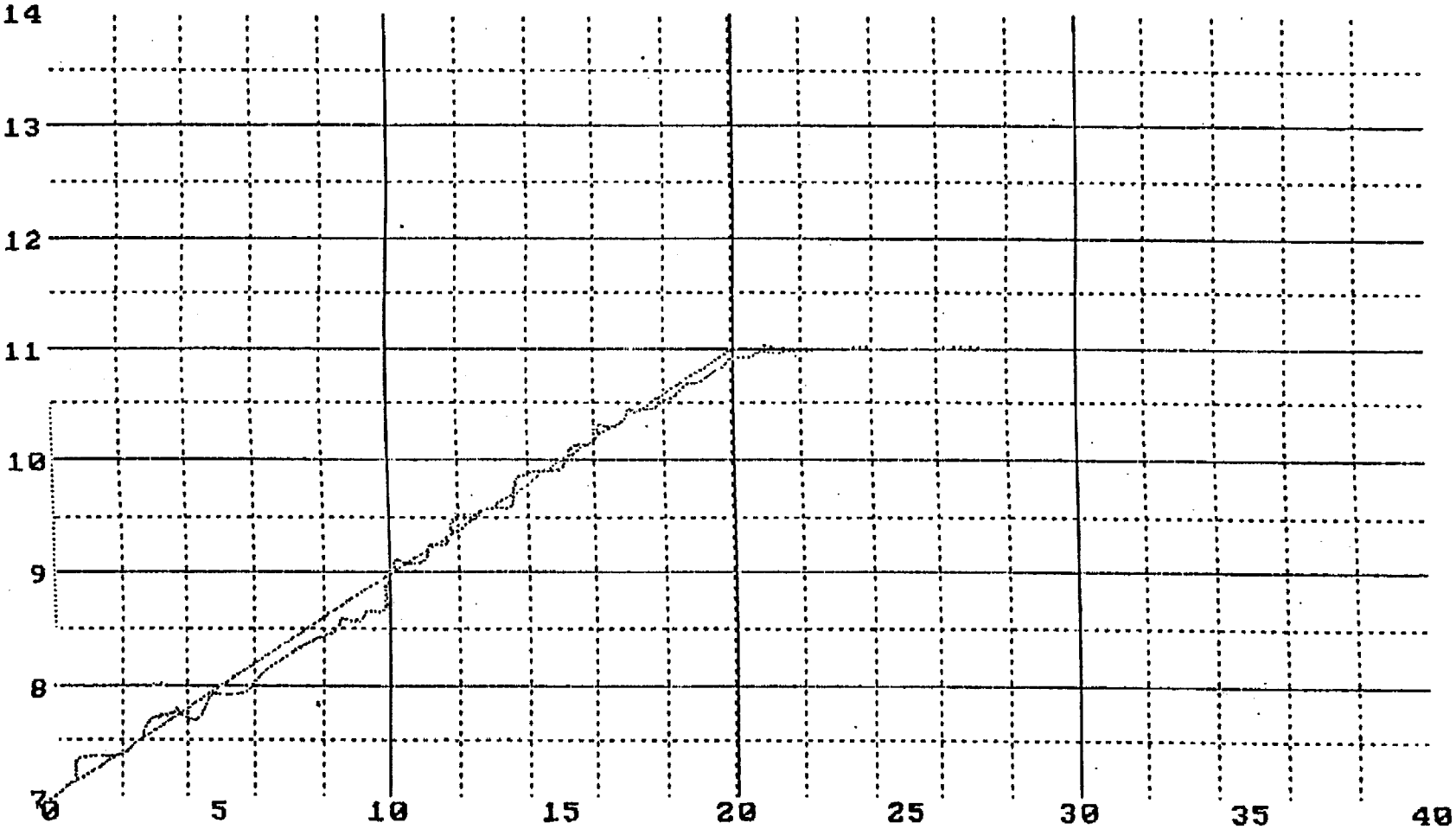
FIG. 7 shows the time response curves of the pH control mode.
Figure 8:
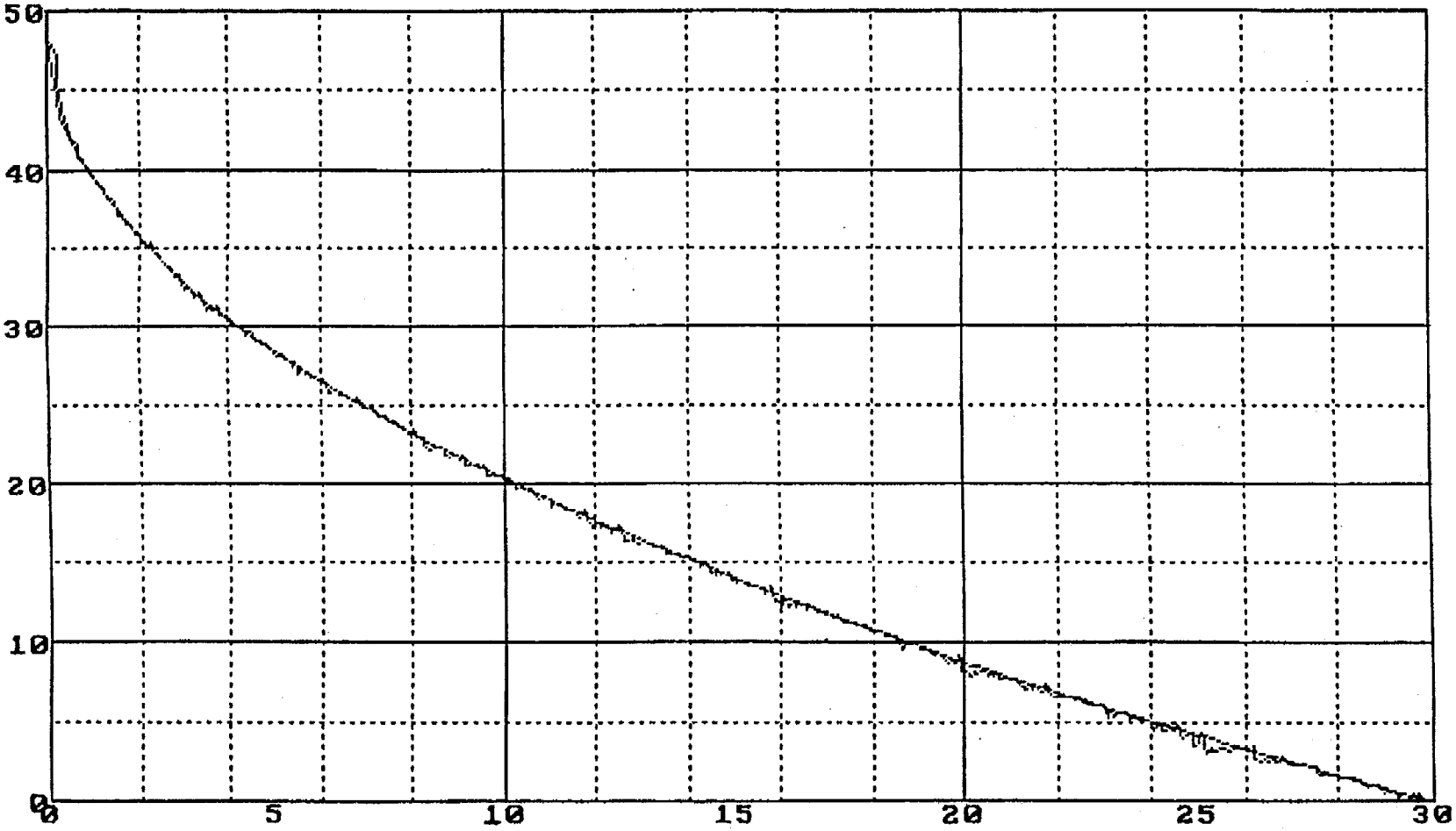
FIG. 8 shows the time response curve of the volume control mode.

As shown in the FIGS. 3–6, and separately shown in FIGS. 7 and 8, these two aspects are important in the time influence curves. The fundamentals of the pH value control mode are shown in FIG. 3. In this graph, the pH input value is pHin. This value may be calculated rapidly. But generally the users have different dyeing requirements, they may choose to add acid or alkali to the tank and set the appropriate mode. They can determine their own chemical timing or their own pH curves. Usually the range of the dye pH value is a linear graph. Referring to FIG. 4, it shows the examples of the curves. Each curve is within the control timing in 10–20 seconds, the user can see that dye machine pH value reaches to an equilibrium condition. The slope of the graph is affected by the error of timing. The slope of curve number 1 is the largest and offers the best control and that of the curve 3 is the least controllable but is most suitable for controlling a high absorption rate dyeing process. pHc is an instruction for adding chemicals, Gp is the proportional gain, pHe is the pH error, pHout is a true pH value of the liquid. The real pH value can be found after the pHin is entered. Once this has been performed, the pH gauge 2 in dye machine measures the real pH value pHout and feeds it back to the controller 5. Here the controller 5 calculates an operational ratio with the preset target pH value. The error of pH value pHe is calculated. To calculate the add chemical directive pHc (i.e the driven information number), the machine multiplies by the ratio increase Gp. pHc is correlated to the add chemical mechanism. For example: chemical valve 11 opens and adds chemicals.

When pHe is minus (the input pH value pHin is subtracted from the real pH value pHout and the result is a minus value), the chemical valve 11 does not move. When a pH value pHout is smaller with comparing to input pH value pHin then the ratio will become positive and add chemical valve 11 will start to operate. The rate increase Gp reflects the system setting of circulation time. Because of the different characteristics of different dye machines, you may need to change the circulation time, or particular pH value pHout may necessitate a change in the setting of the target value, or maybe it is best if circulation is restricted. The adding chemical process and the target of the pH value is achieved by the present invention.

Figure 5:
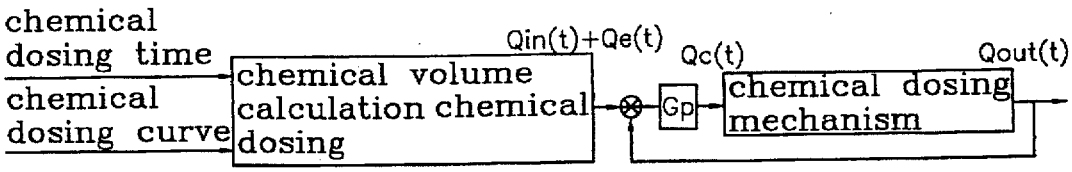
FIG. 5 shows the flow chart for the function of he dosing control mode.
Figure 6:
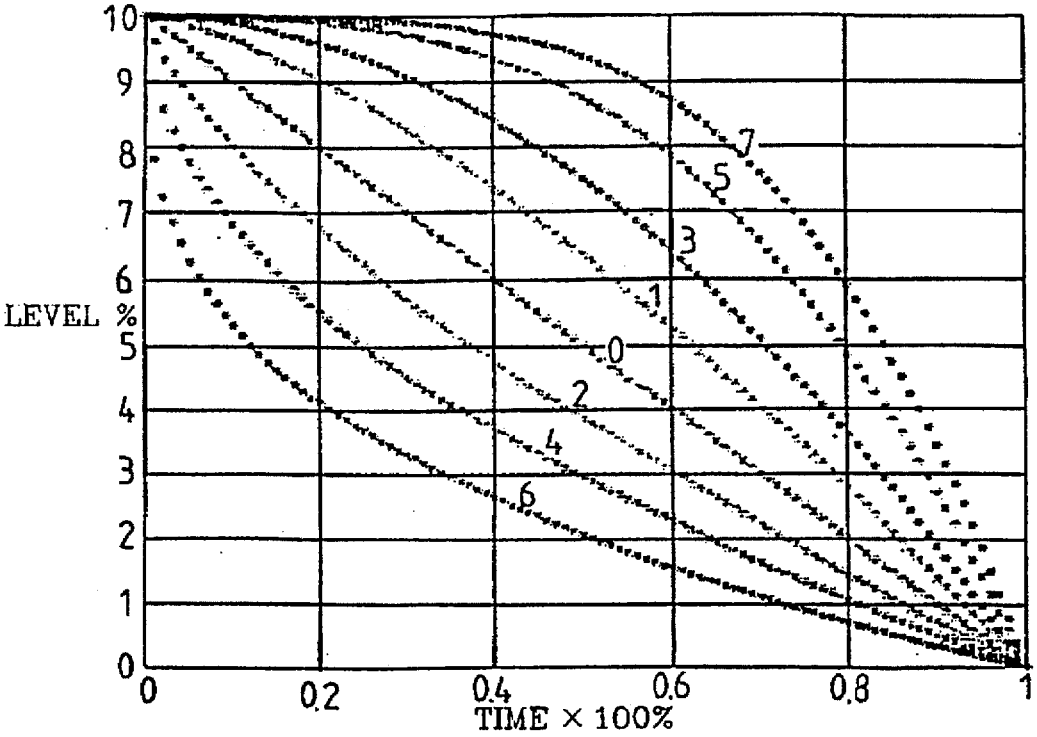
FIG. 6 shows the curve for the chemical of the dosing control mode.

FIG. 5 illustrates the basic principle of the volume control mode of the present invention, wherein Qin is the chemical input volume, Qc is the chemical adding command, Gp is the propotional gain, Qe represents chemical error, and Qout shows the true chemical volume. After the user inputs the chemical curve and chemical input time, the chemical volume calculation occurs and we get chemical input time Qin. This means that controller 5 will automatically divide the liquid in tank 8 into several parts during the input time. Sampling time can be set in 3–5 time units. This example can be seen in the chemical curve of the FIG. 6.

The present invention is convenient for the consumer. After a few tries the user can select several different types of dye process and chemical curves. Amongst this group of chemical curves, the linear and add numbered curves cause a gradual pH change, and have more practical uses. curve #0 is a linear curve, so are curves #1,3,5,7 etc. These curves are function increase curves (each curve has a different slope increasing rate). Curves #2,4, 6, and 8 are function decrease curves. Among the curves described above, the bigger the slope, the longer the sampling time and the worse the precision or the longer the chemical time, the higher the precision. Division precision can be shown thus:

Smallest chemical volume=the chemical tank total liquid volume/(chemical input time in minutes×60 seconds/sampling time).

From this you know clearly that curve #7 can make the dye pH value produce an effect that is closer to a linear one and the dyeing will be better. Therefore the present invention provides the best and most practical chemical input control for the dyeing process.

Similarly, after the production of the chemical input volume Qin (desribed above), the depth gauge 9 feeds the real chemical volume Qout (in chemical tank 8) back to the controller 5. The Controller 5 compares the two (Qin and Qout) and produce the volume error Qe and then multiply Qe by ratio increase Gp to produce the chemical input directive Qc (i.e. the driving signal number). Thus the driving chemical input mechanism, which is correlated to the chemical input valve 11 described above, and the action of valve 11 will be similar to that in the pH control mode. Ratio increase Gp is the same as that in the pH control mode, so the bigger the ratio increase, the longer the opening time of valve 11. Thus the chemical volumes added is also precisely controlled by this mode.

The construction, operation, control, and fundamentals of the batch dyer with the automatic chemical input and pH control system is described hereinbefore. The characteristics and value to business of the present invention are summarized in the following.

1. High Performance and precision in the return loop and control of input of chemical.

2. Easy to operate the chemical input system—This system is different from the conventional system and is much more convenient then the conventional system. However, this system is similar to the old systems in that an old dye machine can be altered to fit the new system specifications. An old system could achieve the same chemical input operation with some changes about the pipe arrangements and the control lines. The owner who owns conventional dyeing equipment need not to discard his equipment so that this invention can save the cost for the replacement of new equipment.

3. This equipment has good expansion capablity and increases a dye machine controllability. If you buy this dyeing system you can connect it with the surrounding equipment which should be similar to that used in the dye control system of the present invention.

4. The automatic ability of dye machine is increased and product quality is also improved.

5. The present invention is in accordance with poduction process standards and reduces human error.

6. The personnel costs is saved and dyeing effectiveness is increased.

7. The chemical and dye material volumes is saved and the costs is also reduced.

8. The ability to dye eveness material and cloth is improved.

As shown above, framework, technique, contents, and technical basis of the present invention are unique. The efficiency of dye circulation and dye machine operation is improved by the batch dye and automatic chemical input and pH control system structure of the present invention. The present invention reduces working time, and improves the dyeing process. Furthermore, it improves the quality of the production process, and increases the product competitiveness.

In compliance with the status, the invention has been described in language more or less specific as to structural and methodical features. It is to be understood, however, that the invention is not limited to the specific features shown and described, since the device herein disclosed comprises preferred forms of inputting the invention into effect. The invention is, therefore, claimed in any of its forms or modifications within the proper scope of the appended claims appropriately interpreted in accordance with doctrine of equivalents.

We claim:

1. An immersion dye system with automatic chemical input and pH value control, comprising:

a dye machine containing a dye liquor, a pH gauge measuring pH value of the dye liquor, a thermometer measuring a temperature of the dye liquor, a chemical tank containing a dye chemical, the chemical tank being in controllable fluid communication with the dye machine, a continuous action depth gauge being installed in the chemical tank and measuring level of the dye chemical therein, supplying means providing said fluid communication and conducting the dye chemical from the chemical tank to the dye machine, and a controller receiving measurements from said pH gauge, thermometer and depth gauge and having pH value control and volume control modes of operation, desired pH values and dye chemical input parameters being input in the controller during the pH value control mode of operation and the volume control mode of operation, respectively;

said supplying means further including:

a chemical input pump connected to an output of the chemical tank, a mixing valve connected to an output of the chemical tank and mixing the dye liquid flowing from the chemical tank, and a chemical input valve positioned between the chemical input pump and the dye machine;

said controller controlling operation of said chemical input pump, mixing valve and chemical input valve according to said desired pH values and dye chemical input parameters and in response to said measurements received from the pH gauge, thermometer, and depth gauge.

2. The system as claimed in claim 1, operating at a temperature below 100 degrees C. and pressures below 1 kg/cm2 in the pH control mode.

3. The system as claimed in claim 1, wherein the controller includes an industrial computer and contains a control function of network and monitor.

4. The system as claimed in claim 1, wherein the pH control mode and volume control mode are individually operated.

5. The system as claimed in claim 1, wherein the controller operates under a pH control mode for adding acid and alkali, wherein the desired pH values constitute curves on respective graphs preset in the controller, the curves having respective slopes, and wherein the preset pH curve ratio of slope is chosen to be the highest for the better control.

6. The system as claimed in claim 1, wherein in the volume control mode a precise operation is achieved by a long chemical input time period.

7. The system as claimed in claim 6, wherein in the volume control mode the smallest volume of chemical is equal to the total liquid volume of the chemical tank/time for adding chemical agent (in minutes)×60 (seconds)/sampling time.

8. The system as claimed in claim 1, further including a drain valve positioned at the bottom of the chemical tank.

9. The system as claimed in claim 8, wherein the mixing valve, the chemical input valve and the drain valve constitute a batch-dyeing system, each of the mixing valve and the chemical input valve including an electromagnet valve, and the drain valve being manually operated.

* * * * *